United States Patent [19]

Rodgers

[11] Patent Number: 4,978,279

[45] Date of Patent: Dec. 18, 1990

[54] SIMPLIFIED INLET GUIDE VANE CONSTRUCTION FOR A ROTARY COMPRESSOR

[75] Inventor: Colin Rodgers, San Diego, Calif.

[73] Assignee: Sundstrand Corporation, Rockford, Ill.

[21] Appl. No.: 240,721

[22] Filed: Sep. 6, 1988

[51] Int. Cl.[5] ..... F01B 25/02

[52] U.S. Cl. ..... 415/151; 415/148

[58] Field of Search ..... 415/148, 150, 151, 163, 415/144, 165; 60/39.07

[56] References Cited

U.S. PATENT DOCUMENTS

| | | | |
|---|---|---|---|
| 1,887,873 | 11/1932 | Hagen | 415/151 |
| 3,723,021 | 3/1973 | Bartholomew | 415/147 |
| 3,799,694 | 3/1974 | Duzan | 415/148 |
| 3,905,191 | 9/1975 | Matto | 60/39.07 |
| 4,053,256 | 10/1977 | Hertel | 415/161 |
| 4,167,368 | 9/1979 | Brobeck | 415/163 X |
| 4,182,117 | 1/1979 | Exley | 60/39.07 |
| 4,301,649 | 11/1981 | Walker | 60/39.07 |
| 4,389,158 | 6/1983 | Nakanishi | 415/151 X |
| 4,428,714 | 1/1984 | Mowill | 415/161 |
| 4,470,256 | 9/1984 | Palmer | 415/150 X |
| 4,617,799 | 10/1986 | Todokoro et al. | 415/151 |
| 4,657,481 | 4/1987 | Mowill et al. | 415/151 |

FOREIGN PATENT DOCUMENTS

| | | | |
|---|---|---|---|
| 982583 | 6/1951 | France | 415/151 |
| 53-34109 | 3/1978 | Japan | 415/151 |
| 56-92327 | 7/1981 | Japan | 60/39.07 |
| 18499 | 1/1982 | Japan | 415/148 |
| 252875 | 10/1948 | Switzerland | 415/151 |
| 387145 | 10/1973 | U.S.S.R. | 415/151 |
| 714050 | 2/1980 | U.S.S.R. | 415/151 |

*Primary Examiner*—John T. Kwon

*Attorney, Agent, or Firm*—Wood, Phillips, Mason, Recktenwald & VanSanten

[57] ABSTRACT

The expense of variable inlet guide vane structure for rotary compressors is avoided in a structure including a compressor housing 20 with an inlet end 24 and a rotor 10 journaled within the housing 20 by disposing a housing 42 about the inlet end 24 and having an inlet port 54 over a minor fraction of its periphery. A single guide vane 60, is disposed within the inlet port 54 to impart preswirl to incoming air as it enters the housing 42.

7 Claims, 1 Drawing Sheet

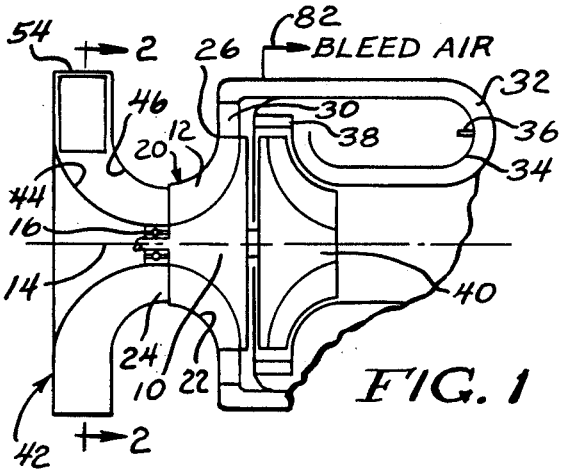
FIG. 1
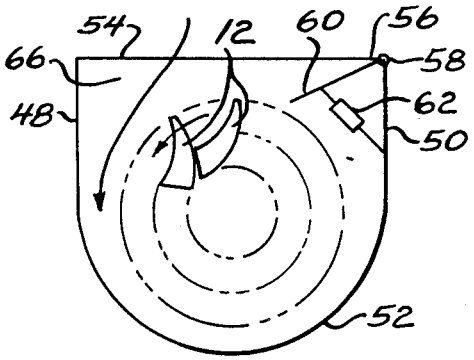
FIG. 2
FIG. 3
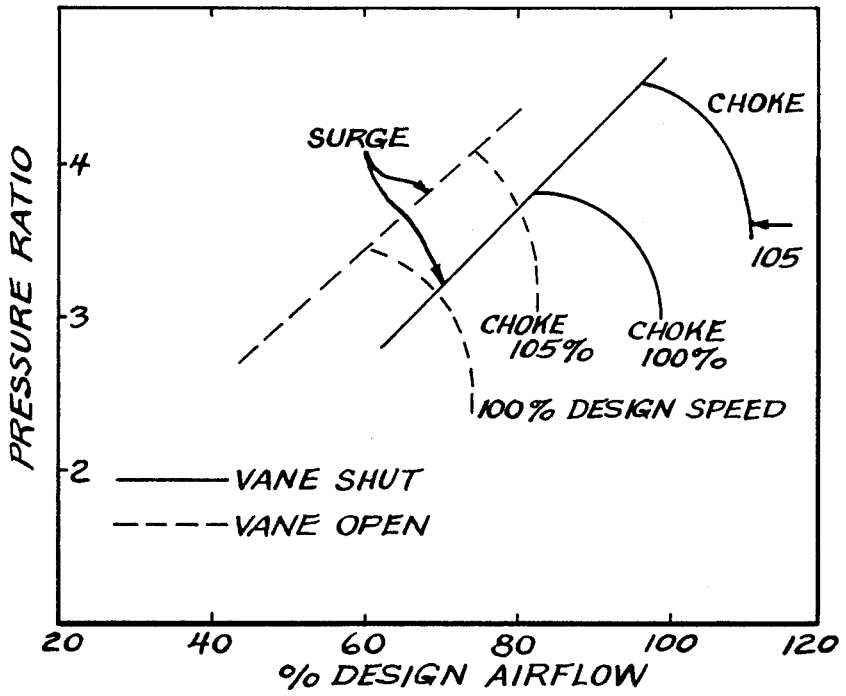
FIG. 4
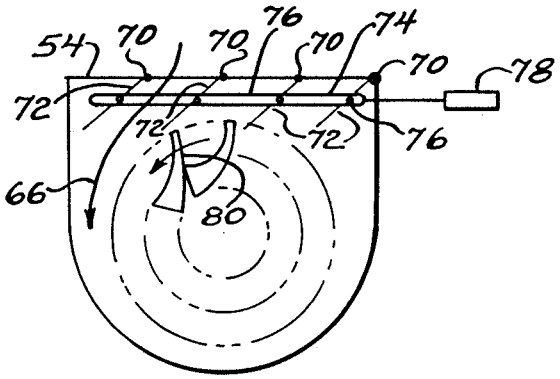

SIMPLIFIED INLET GUIDE VANE CONSTRUCTION FOR A ROTARY COMPRESSOR

FIELD OF THE INVENTION

This invention relates to rotary compressors as might, for example, be coupled with a turbine wheel to provide a turbine engine, and more particularly, to a simple but effective variable inlet guide vane structure for such compressors.

BACKGROUND OF THE INVENTION

Flow ranges for single stage centrifugal compressors are set by the stalling characteristics of the impeller and the diffuser. These characteristics are intrinsically controlled by the diffusion capability or attainable static pressure rise across the blades in the vane rows. Generally, although not always, vaned diffuser systems are utilized in centrifugal compressors because they provide maximum efficiency at high Mach numbers. The vanes of the impeller and the diffuser must be matched simultaneously at their peak efficiency flow conditions.

It has been determined that in a vaned diffuser wherein the vanes are stationary, the diffuser tends to be the flow controlling component. Its overall Mach number level and inlet blockage are higher than those of the impeller which operates over a large radial variation of Mach numbers from hub to shroud in a radial discharge compressor. The diffuser is required to accept an already partially diffused flow from the impeller with resulting non-uniform entrance conditions about the inlet to the diffuser. This further aggravates stalling sensitivity and curtails the compressor operating range. Consequently, stationary vane diffusers for centrifugal compressors have received considerable attention.

Attainment of a wide flow range requires that the impeller and the diffuser be capable of extended operation into their stalled or positive incidence regions to flows where static pressure rise attains a plateau, and compressor surge is eventually triggered. Stage surge is believed to stem from operation on an unstable portion of the overall compressor characteristic curve whereat the static pressure ratio increases with increasing flow.

One effective method of increasing compressor operating range is to provide sufficient impeller stability so that the downstream diffuser can operate slightly into its positive incidence zone even though the diffuser static pressure recovery versus flow characteristic exhibits a slope indicative of unstability. Conventionally, increased impeller stability is obtained by imparting an initial swirl of the incoming gas at the compressor inlet in the direction of compressor rotation. To provide such stability over a wide range of flows, so-called variable inlet guide vane geometry is frequently employed. See, for example, U.S. Pat. No. 4,428,714 issued Jan. 31, 1984 to Mowill. While such variable inlet guide vane structures work well for their intended purpose, the guide vanes are typically pivoted about an axis with a substantial radial component and as a consequence, rather complicated linkages are required in order to simultaneously rotate the various vanes in a uniform manner. Consequently, rotary compressors having variable inlet guide vane geometry are substantially more complex than those without it and accordingly more expensive.

The present invention is directed to providing a rotary compressor with a simplified inlet guide vane structure to avoid the complexity and expense of the prior art.

SUMMARY OF THE INVENTION

It is the principal object of the invention to provide a new and improved rotary compressor. More specifically, it is an object of the invention to provide a rotary compressor with a new and improved variable inlet guide vane structure.

An exemplary embodiment of the invention achieves the foregoing object in a rotary machine including a rotary compressor housing having an axially facing inlet end for receiving a gas to be compressed, an outlet end for dis-charging compressed gas and a rotor receiving opening extending between the inlet and the outlet. A rotor having vanes is disposed in the opening and means mount the rotor for rotation within the opening. An inlet muff is mounted on and is in fluid communication with the inlet end and has a radially outward facing periphery provided with an inlet opening whose peripheral length is less than half of the periphery. The muff extends completely around the inlet end and at least one vane is mounted to the muff adjacent the inlet opening and is movable with respect thereto to change the angle of gas flow through the opening to the inlet end of the compressor housing. That portion of the muff not including the inlet opening is free of such movable vanes and means are provided for selectively moving the vane or vanes.

In one embodiment of the invention, there are a plurality of spaced ones of the vanes in a generally linear row extending across the inlet opening. This arrangement considerably simplifies the inlet guide vane operating linkage construction.

According to another embodiment of the invention, there is but a single one of the vanes which is pivoted to the muff at one end of the inlet opening and extends into the muff toward the inlet end of the compressor housing. This facet of the invention provides an extremely simple, but effective guide vane structure.

In a preferred embodiment, the muff is generally U-shaped and includes imperforate legs interconnected by an imperforate bight to define an inlet manifold. The legs and the bight are all located radially outward of the inlet end of the compressor housing but axially adjacent thereto. That part of the inlet housing between the legs and opposite of the bight defines a radially opening inlet port receiving the vane or vanes.

In a highly preferred embodiment, the inlet port is generally planar.

According to a preferred embodiment, the rotary machine is employed in a turbine engine which includes a turbine wheel connected to the rotor, a combustor connected to the outlet end of the compressor housing, and a turbine nozzle disposed about the turbine wheel and connected to the combustor.

In one embodiment of a turbine engine made according to the invention useful for providing relatively high bleed air flows, means are provided for obtaining bleed air downstream of the outlet end of the compressor housing and the vane is located to impart a rotation to air entering the inlet port that is opposite the intended direction of rotation of the rotor.

Other objects and advantages will become apparent from the following specification taken in connection with the accompanying drawings.

DESCRIPTION OF THE DRAWINGS

FIG. 1 is a somewhat schematic, sectional view of a turbine engine embodying a rotary machine made according to the invention;

FIG. 2 is a schematic sectional view taken approximately along the line 2—2 of FIG. 1;

FIG. 3 is a plot of pressure ratio versus the percent design air flow of actual test data obtained during the operation of the embodiment of FIGS. 1 and 2; and FIG. 4 is a view similar to FIG. 2 but of a modified embodiment of the invention.

DESCRIPTION OF THE PREFERRED EMBODIMENTS

An exemplary embodiment of a rotary machine made according to the invention is illustrated in the drawings and with reference to FIGS. 1 and 2 is seen to include a rotor 10 having a plurality of generally radially outwardly directed vanes 12. The rotor 10 is journaled for rotation about an axis 14 by means of bearings 16. The rotor 10 is located within a housing shown somewhat schematically at 20 and particularly, within a housing opening 22 which extends between an inlet end 24 for receiving a gas to be compressed, usually air, and an outlet end 26 for discharging a compressed gas. As a consequence, a radial discharge rotary compressor is defined.

Just radially outwardly of the discharge or outlet end 26 is an annular diffuser 30 of the stationary vane sort. It in turn is in fluid communication with an annular plenum 32 which surrounds an annular combustor 34 of conventional construction. The combustor 34 is adapted to receive fuel via fuel injectors 36 as well as compressed air from the diffuser 30, combust the resulting mixture, and discharge it through an annular turbine nozzle 38 against a radial inflow turbine wheel 40 coupled to the rotor 10.

In fluid communication with the inlet end of the compressor housing 20 is a so-called muff, generally designated 42. Two axially and radially spaced bell-like walls 44 and 46 define an annular plenum that is axially aligned with the inlet end 24 of the housing 20. As best seen in FIG. 2, in addition to the bell-shaped components of the walls 44 and 46, each is generally U-shaped having spaced, imperforate walls 48 and 50 at the leg position and a similar, imperforate wall 52 at the bight position. Between the leg-like walls 48 and 50, and opposite of the bight 52, a planar port 54 exists. As can be seen, the peripheral length of the port 54 is considerably less than half of the peripheral length of the walls 48, 50 and 52 which are, of course, radially facing walls.

Adjacent one edge 56 of the port 54, a pivot 58 is located. The axis of the pivot 58 is parallel to the axis 14 and a generally planar vane 60 is disposed within the port 54 and connected to the housing 42, for movement within the port 54 by the pivot 58. An actuator shown schematically at 62 may be utilized to adjust the position of the vane 60 within the port 54.

In any event, the vane 60 can be adjusted within the port 54 to impart some desired degree of preswirl to incoming air as indicated by an arrow 66. By suitably adjusting the position of the vanes 60, the degree of preswirl may be matched to the desired flow at any point in time during the operation of the machine.

FIG. 3 graphically illustrates the increase in useful working range between the point of surge and the point of choke that can be obtained using a single vane such as illustrated in the embodiment of FIGS. 1 and 2.

In some cases, more than a single one of the vanes 60 may be utilized. FIG. 4 shows such an arrangement. In the embodiment of FIG. 4, there are four spaced pivots 70, all parallel to the rotational axis 14, across the port 54 and each pivotally mounts a corresponding vane 72 which extends into the muff or housing 42. An elongated link 74 interconnects each of the vanes 72 by means of pivot pins 76. An actuator 78 is connected to the link 74 and by moving the same can simultaneously adjust the angle of each of the vanes 72.

Generally speaking, the vanes 72 will be set up to impart a degree of preswirl to incoming air or gas to be compressed in the direction of the arrow 66 which is in the same direction as the direction of rotation of the rotor 10 as indicated by an arrow 80. In this case, a maximum surge margin is provided.

However, in some usages, as when the rotary machine is included in a turbine having provision for the diversion of large quantities of so-called bleed air as shown schematically at 82 in FIG. 1, the vanes 72 may be oriented oppositely from the position shown in FIGS. 2 and 4 for the same direction of rotation of the rotor 10. In this case, there will be a decrease in surge margin but a substantial increase in flow rate.

From the foregoing, it will be appreciated that a simplified variable inlet guide vane structure made according to the invention can substantially increase the operating range between surge and choke or provide sizable quantities of bleed air. Yet, the actual construction of the inlet guide vane is simple and inexpensive, allowing variable inlet guide vanes to be employed in rotary compressors with a minimal expense.

I claim:

1. A rotary machine including:

a rotary compressor housing having an axially facing inlet end for receiving a gas to be compressd, an outlet end for discharging compressed gas and a rotor receiving opening extending between said inlet and said outlet;

a rotor having vanes disposed in said opening;

means mounting said rotor for rotation within said opening;

an inlet muff mounted on and in fluid communication with said inlet end and having a radially outward facing periphery provided with an inlet opening whose peripheral length is less than half of said periphery, said muff extending completely around said inlet and a single vane pivoted to said muff at one end of said inlet opening and extending into said muff toward said inlet end and movable with respect thereto to change the angle of gas flow through said opening to said inlet end, the portion of said muff not including said inlet opening being vane free; and means for selectively moving said vane.

2. A rotary machine including:

a rotary compressor housing having an axially facing inlet end for receiving a gas to be compressed, an outlet end for discharging a gas to be compressed and a rotor receiving opening extending between said inlet and said outlet;

a rotor having vanes disposed in said opening;

means mounting said rotor for rotation within said opening;

an inlet housing in fluid communication with said inlet end and being generally U-shaped with imperforate legs interconnected by an imperforate bight to define an inlet manifold, in fluid communication with said inlet end, said legs and said bight all being located radially outward of said inlet end but axially adjacent thereto; that part of said inlet housing between said legs and oppositely of said bight defining a radially opening inlet port;

a single vane in said port and pivoted for rotation about an axis generally parallel to said rotor axis; and a motor for pivoting said vane.

3. The rotary machine of claim 2 wherein said port is generally planar.

4. The rotary machine of claim 2 wherein said rotary machine is a turbine engine and said gas is air, a turbine wheel connected to said rotor, a combustor connected to said outlet end, and a turbine nozzle about said turbine wheel and connected to said combustor.

5. The turbine engine of claim 4 wherein means are provided for obtaining bleed air downstream of said outlet end and said vane is located to impart a rotation to air entering said port that is opposite the intended direction of rotation of said rotor.

6. The rotary machine of claim 2 wherein said vane is generally planar and is pivoted at one end within said port.

7. The rotary machine of claim 6 wherein said vane extends from the pivot in a generally radical direction toward the axis of said rotor.

* * * * *